US005402757A

United States Patent [19]

Eller et al.

[11] Patent Number: 5,402,757

[45] Date of Patent: Apr. 4, 1995

[54] FLAME GLOW UNIT

[75] Inventors: Martin Eller, Ludwigsburg; Odd Peters, Bietigheim-Bissingen, both of Germany

[73] Assignee: Beru Ruprecht GMBH & Co. KG, Ludwigsburg, Germany

[21] Appl. No.: 172,213

[22] Filed: Dec. 23, 1993

[30] Foreign Application Priority Data

Dec. 23, 1992 [DE] Germany ..... 42 43 965.5

[51] Int. Cl.[6] ..... F02N 17/047; F02P 19/02

[52] U.S. Cl. ..... 123/179.21; 123/556; 123/550; 431/11

[58] Field of Search ..... 123/179.6, 179.21, 550, 123/556; 431/90, 207, 66, 18, 11, 25, 70, 71

[56] References Cited

U.S. PATENT DOCUMENTS

| | | | |
|---|---|---|---|
| 3,400,699 | 9/1968 | Van Kirk et al. | 123/550 |
| 3,602,206 | 8/1971 | Kern et al. | 123/179.21 |
| 4,027,642 | 6/1977 | Kamada et al. | 123/550 |
| 4,587,941 | 5/1986 | Mishina et al. | 123/550 |
| 4,639,871 | 1/1987 | Sakai et al. | 123/179.21 |
| 5,130,517 | 7/1992 | Schmid et al. | 123/550 |
| 5,138,987 | 8/1992 | Schmid et al. | 123/179.21 |
| 5,182,437 | 1/1993 | Schmid et al. | 123/179.21 |

FOREIGN PATENT DOCUMENTS

| | | |
|---|---|---|
| 0448830 | 12/1990 | European Pat. Off. . |
| 2807149 | 2/1978 | Germany . |
| 3342865 | 11/1983 | Germany . |
| 4032758 | 10/1990 | Germany . |

*Primary Examiner*—Tony M. Argenbright
*Assistant Examiner*—M. Macy
*Attorney, Agent, or Firm*—Sixbey, Friedman, Leedom & Ferguson

[57] ABSTRACT

Flame glow unit for heating the combustion air for a combustion device, especially an internal combustion engine. A flame glow plug, which is placed in the air duct of the combustion device, is supplied by a control device with current and fuel, and forms an ignitable air-fuel mixture together with the in-flowing air, which is ignited by a heating element provided in the flame glow plug. The resulting flame heats the air in the air duct. The air current in the air duct is measured by an air current measuring device and the control device controls the fuel supply of the flame glow plug in response to the measurements which the control device receives from the air current measuring device.

14 Claims, 1 Drawing Sheet

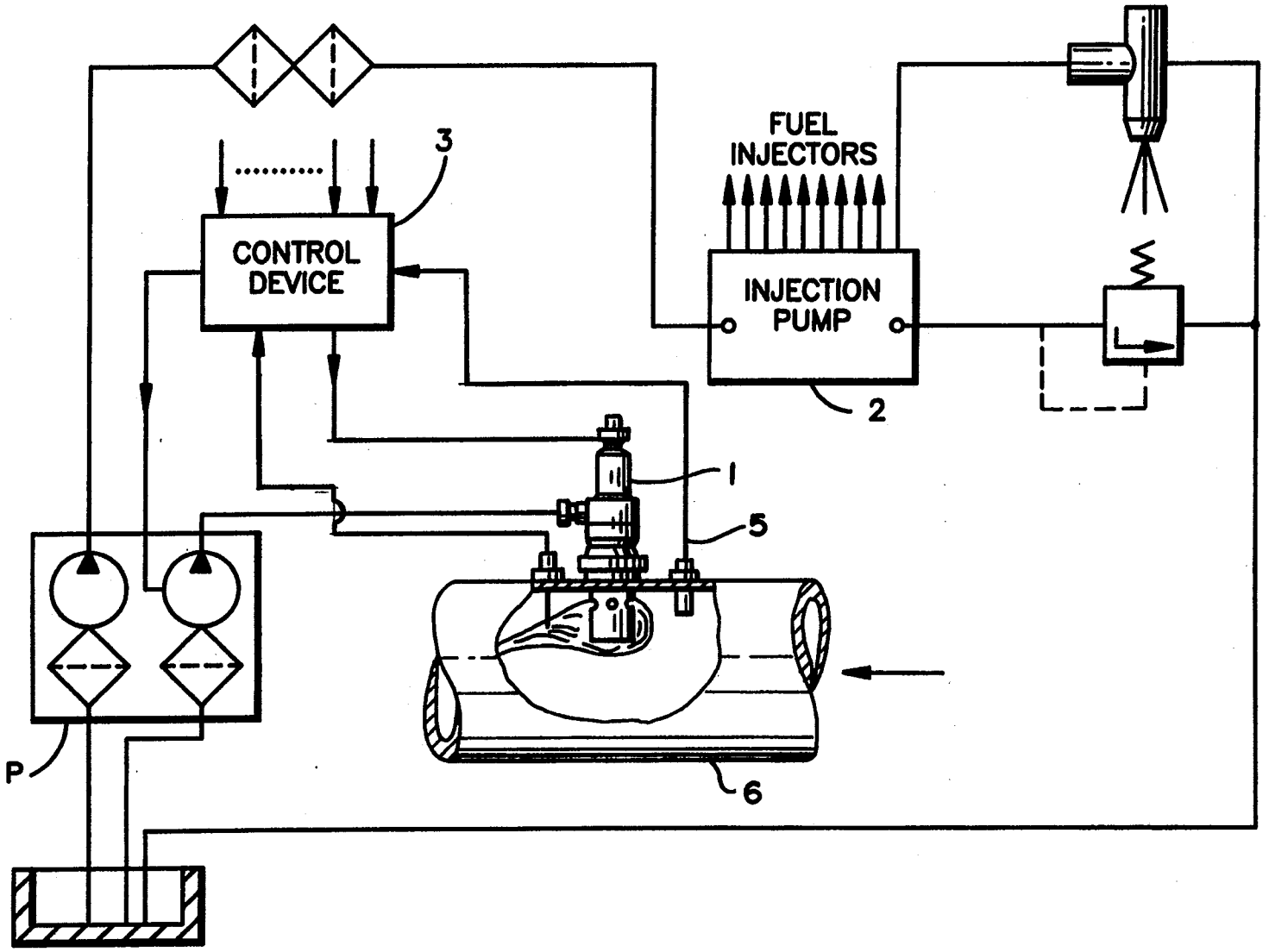
FUEL INJECTORS
INJECTION PUMP
2
1
5
6
3
CONTROL DEVICE
P

FLAME GLOW UNIT

BACKGROUND OF THE INVENTION

1. Field of the Invention

The invention relates to a flame glow unit for heating the combustion air for a combustion device, especially an internal combustion engine, of the type having a flame glow plug, which is placed in the air duct of the combustion device, a current supply device for the flame glow plug, a fuel supply device for the flame glow plug and a control device for the current and fuel supply of the flame glow plug.

2. Background of the Invention

A flame glow unit of the type mentioned above known, for example, from German published application nos. DE 33 42 865 C2 and DE 40 32 758 A1. Such a glow unit is used, for example, as a cold starting aid for the combustion device and especially for preheating the intake air and boost air of internal combustion engines, such as diesel engines, as well as for suppressing smoke in the waste gas during and after the starting phase.

In the flame glow unit known from German published application DE 33 42 865 C2, a switching device is provided as a control device, with which the heating element of the flame glow plug is quickly heated and is then further operated with reduced heating power, which is achieved by a fixed-cycle operation with a preset pulse to no-current ratio. This control is produced, in this case, by a temperature switch or a time switch.

In the flame glow unit known from German published application DE 40 32 758 A1, the control device is further designed so that the flame glow plug is provided both with current and with fuel in a synchronized manner.

In such flame glow units, it is desired that the processing of the fuel-air mixture for the flame glow plug takes place, optimally, over the entire load range of the combustion device, especially the entire load range and rpm range of the internal combustion engine. But, this optimal processing of the mixture does not exist in the case of the known flame glow units, since the operating conditions of the related combustion device are not sufficiently taken into consideration.

SUMMARY OF THE INVENTION

Therefore; a primary object of the present invention is to provide a flame glow unit of the initially mentioned type in which the air-fuel mixture of the flame glow plug always corresponds to the operating conditions of the combustion device with which it is being used.

In accordance with a preferred embodiment, this object is achieved by an air current measuring device being provided in an air intake duct of an internal combustion engine, a control device for the glow plug responding to the output of the measuring device and correspondingly controlling the fuel supply for the flame glow plug.

These and further objects, features and advantages of the present invention will become apparent from the following description when taken in connection with the accompanying drawings which, for purposes of illustration only, show single embodiment in accordance with the present invention.

BRIEF DESCRIPTION OF THE DRAWINGS

The sole figure schematically depicts a preferred embodiment of the flame glow unit according to the invention.

DETAILED DESCRIPTION OF THE PREFERRED EMBODIMENT

The embodiment of the flame glow unit according to the invention represented in the drawing is used to heat air in air intake duct 6 of an internal combustion engine, especially a diesel engine.

A flame glow plug 1, which is provided with fuel by an injection pump 2 and with current by a control device 3, is placed in air intake duct 6. In flame glow plug 1, the fed fuel is mixed with air, which enters flame glow plug 1 via holes in a protecting tube with which flame glow plug 1 is placed in air intake duct 6. Because of the current supply of the heating element or glow element of flame glow ;plug 1, this mixture is ignited, so that a flame forms, which heats the air in air intake duct 6.

An air current meter, especially an air speed meter or air volume meter 5 is placed on the upstream side of the glow plug 1 relative to the incoming flow of air to be heated in intake duct 6. The output signal of meter 5 is delivered to control device 3. Control device 3 controls the fuel supply to flame glow plug 1 in proportion to the air volume/speed in air intake duct 6, which is indicated to the latter by air meter 5. In this way, a fuel volume is delivered to the flame glow plug that is suitable for the air volume that enters the flame glow plug 1. The fuel is delivered to the flame glow plug 1 by a pump P, which can be, for example, a plunger pump, whose stroke frequency is changed to match changes in the air flow volume. In this connection, a constant fuel volume per combustion stroke is pumped and the stroke frequency is controlled by the air meter via the control device 3. As a result, the fuel-supply amount is largely independent of the fuel intake pressure in the supply system and extreme pressure peaks can be more easily controlled.

The measurement of the air speed can take place in different ways. A baffle plate can be used, which performs an angular movement with increasing air speed, with this angular movement being converted to an electrical signal which is used by the control device to adjust the stroke frequency of the fuel feed pump P. A hot-wire resistance measuring process can also be used. In this connection, a hot wire heated with a constant current can be exposed to the air current, which causes a cooling of the hot wire and thus a reduction of the resistance of the wire, which can be used as a measurement of the air volume. Especially suitable is the use of a pressure sensor, which detects the absolute pressure inside the air duct, and from a resulting pressure signal, an indication of the air speed can be obtained. In this way, it is possible to match the fuel volume to the respective air volume, so that an optimal combustion is achieved. This is particularly significant to prevent the flame from being blown out in the case of high air intake speed during engine operation.

As far as the current supplied to the flame glow plug 1 by control device 3 is concerned, at the beginning of operation, first, preheating is carried out with a multiple overload, and the necessary energy, taking into consideration the electrical operating parameters of the combustion device, for example, the existing voltage, is allocated by a suitable selection of the level of the heating current and the preheating time. Then, a speed regulation takes place according to preset performance data, and again the existing voltage. Also, the loading state of the battery, the load by other users, etc. are taken into consideration to provide the correct pulse to nocurrent ratio for the measured current supply in the case of a supply with current pulses. Inputing of such control parameters is represented by the arrows shown above control device 3 in the drawing.

The electrical heat energy for evaporation of the fuel in flame glow plug 1 corresponds to the fuel volume put through up to a maximum compatible heat energy to avoid damaging the heating element. This maximum compatible heat energy is reached if, in the heating element, the temperature gradient from inside to outside becomes too great, so that the heating and regulating coils in the heating element of the flame glow plug 1 tend to overheat.

In flame glow plug 1, the fuel is then evaporated and mixed with the entering air, and because of the above-indicated control, an ignitable mixture with high flame propagation speed is produced, whose mixing conditions are optimal, for all load and rpm ranges. If air current meter 5 in the air intake duct indicates air in motion, the heating power of flame glow plug 1 is increased by control device 3 in a suitable way, so that the fuel suitably fed for this purpose can also be prepared and heat dissipation by the air in motion is compensated for. This increase of the heating power, again, takes place until the heating power critical for the heating element is achieved.

The design can be such that the fuel is fed in proportion to the air volume, to the air speed or the absolute dynamic pressure with a separate pump. Such a separate pump may be a continuously feeding pump with fuel pressure produced proportionally to the air volume, a pump which feeds fuel proportionally to the air volume by varying the speed of the driving motor, or a plunger pump which feeds in batches, but which is provided with devices for evening out the fuel discharge.

The heating energy can also be fed continuously, by the heating power being matched by automatic adjustment, in the case of the fuel supply and a regulating wire with a temperature jump characteristic being provided in the flame glow plug, which is cooled by the fuel and results in a higher heating power. An electrically series-connected, matched PTC element, i.e., a resistor element with positive temperature coefficients, can also be connected in series to the heating element in flame glow plug 1, which slowly becomes hot without fuel flowing through it and is used as a protective resistor. This element is correspondingly cooled with fuel flowing through it, so that it will be of lower impedance and allow a greater heating output in the heating element of flame glow plug 1, which is necessary to evaporate the fed fuel.

Flame glow plug 1 preferably, has two or more heating elements, which, after a quick preheating, are pulsed with heating energy, so that the current pulses follow each other without gap timewise and the heat energy supply takes place in heating stages, in which, e.g., in the case of three heating elements, respectively, no heating element, one heating element, two heating elements or all three heating elements are supplied with current alternately or simultaneously.

It is further preferred to support the flame retention by a catalytically acting element in the flame. This element is placed in the area of the flame outlet and is not shown in the drawing.

In the flame glow unit according to the invention, an air current meter 5 is thus provided in intake duct 6 as a sensor, according to whose output signals, the fuel volume and the electrical heating energy of flame glow plug 1 is allocated by control device 3. Instead of using a plunger pump, whose stroke frequency is run proportionally to the air volume, to feed the fuel volume proportionally to the air volume, as described above, such a fuel supply is also achievable with a choke and with a fuel pressure proportional to the air volume. A nozzle adjustable proportionally to the air volume can also be provided, preferably, with use of an approximately constant fuel pressure.

In the operation of the flame glow unit, the electrically heated heating element or elements in flame glow plug 1 is/are provided with current for fuel processing, being heated first with multiple electric excess load, i.e., as quickly as possible, and is reduced taking into consideration the state of the power supply and then the energy supply, for example, by a variable pulse to no-current ratio of the current clock. As soon as fuel is fed, the heat energy necessary, in each case, is allocated as a function of the fed fuel volume by a newly matched variable pulse to no-current ratio. The allocation can be applied as a performance graph in an electronic memory.

Power supply fluctuations can be compensated for by changing the pulse to no-current ratio. In the case of several heating elements, current fluctuations can be counteracted in the pulsed heat energy supply in that the current pulses of the heating elements follow each other without a gap timewise.

A stoichiometric air-fuel mixture in flame glow plug 1 with high flame propagation speed is desired, which is controlled by air current meter 5 and the related fuel supply, for example, the stroke frequency of a plunger pump. Since a fuel volume matching the air volume put through is added, after ignition of the air-fuel mixture, a maximum flame propagation speed of up to a preset upper air volume is assured. The heat energy for the heating element of flame glow plug 1 is allocated by the measurement of the air volume so that the heating element of flame glow plug 1 is not damaged.

The flame glow unit according to the invention has the additional advantage that the fuel volume that can be put through is higher, so that further applications develop, i.e., the flame glow unit can also be used, for example, for bulky truck engines.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Flame glow unit for heating combustion air for a combustion device comprising a flame glow plug, means for mounting the flame glow plug in an air duct of the combustion device, a current supply device for the flame glow plug, a fuel supply device for the flame glow plug and a control device connected to the current and fuel supply devices for controlling supplying of current and fuel to the flame glow plug, and an air current measuring device for measuring air flow in the air duct; wherein said control device is connected to the measuring device, and responsive to measurement signals therefrom, correspondingly controls the supplying of fuel to the flame glow plug.

2. Flame glow unit according to claim 1, wherein the control device controls the supplying of current to the flame glow plug as a function of the fuel supplied to the flame glow plug.

3. Flame glow unit according to claim 2, wherein the control device is operative for increasing the current supply when the air current measuring device detects air in motion in the air duct.

4. Flame glow unit according to claim 3, wherein the current supply has inputs for receiving parameters from the combustion device which indicate the state of the electrical supply of the combustion device.

5. Flame glow unit according to claim 1, wherein the flame glow plug has a self-regulating coil for automatically regulating heating current supplied to the flame glow plug, said self-regulating coil being made of a material with a resistance characteristic which jumps.

6. Flame glow unit according to claim 1, wherein the flame glow plug has a resistor element with a positive temperature coefficient and a heating element, said resistor element being series-connected to the heating element in the flame glow plug and having a resistance which increases proportionally relative to the temperature of the resistor element.

7. Flame glow unit according to claim 1, wherein at least two heating elements are provided in the flame glow plug, and wherein said current supply device provides said heating elements with a timewise continuous series of current pulses.

8. Flame glow unit according to claim 1, wherein a catalytically acting element is provided in a flame area of the flame glow plug.

9. Flame glow unit according to claim 1, wherein said air current measuring device is one of an air speed and an air volume type measuring device.

10. A combustion device for an internal combustion engine having an air intake duct and a flame glow unit for heating combustion air supplied to the air intake duct, said flame glow unit comprising a flame glow plug mounted in the air duct of the combustion device, a current supply device for the flame glow plug, a fuel supply device for the flame glow plug, a control device connected to the current and fuel supply devices for controlling supplying of current and fuel to the flame glow plug, and an air current measuring device for measuring air flow in the air duct; wherein said control device is connected to the measuring device, and responsive to measurement signals therefrom, said control device correspondingly controls the supplying of fuel to the flame glow plug by the fuel device.

11. Combustion device according to claim 10, wherein the control device controls the supplying of current to the flame glow plug as a function of the fuel supplied to the flame glow plug.

12. Combustion device according to claim 11, wherein the control device is operative for increasing the current supply when the air current measuring device detects air in motion in the air duct.

13. Combustion device according to claim 12, wherein said air current measuring device is one of an air speed and an air volume type measuring device.

14. Combustion device according to claim 10, wherein said air current measuring device is one of an air speed and an air volume type measuring device.

* * * * *